United States Patent [19]

Raine

[11] 4,252,037

[45] Feb. 24, 1981

[54] PLUG WRENCH

[76] Inventor: Fred L. Raine, 25 Delaware Dr., Penns Grove, N.J. 08069

[21] Appl. No.: 9,779

[22] Filed: Feb. 6, 1979

[51] Int. Cl.[3] ..... B25B 13/48

[52] U.S. Cl. ..... 81/90 C; 81/121 B

[58] Field of Search ..... 81/90 C, 90 D, 121 R, 81/121 A, 121 B

[56] References Cited

U.S. PATENT DOCUMENTS 3,134,291 5/1964 Barry ..... 81/90 C X 3,620,106 11/1971 Dixon ..... 81/121 R

*Primary Examiner*—James G. Smith

[57] ABSTRACT

A wrench for gripping and turning an oil plug of a Briggs and Stratton engine, and including a working head at one end of a handle, the head having a circle of openings for receiving a pair of upward posts formed upon the oil plug; and the improved plug wrench, in one design, including a circular groove on each side of the head for guiding the posts into the openings each time that the wrench is disconnected, and then reconnected, while making several partial turns of the handle.

1 Claim, 7 Drawing Figures

PLUG WRENCH

This invention relates to oil plug wrenches.

A principal object of the present invention is to provide a wrench designed particularly for turning an oil plug of a Briggs and Stratton engine, wherein such plugs are provided with two upward extending posts or prongs integrally formed on top of the plug, and which, heretofore, most persons tried to loosen and turn by inserting a screwdriver between the posts and then turning. However, such procedure sometimes results in breaking off the posts, so it is not the ideal method.

Accordingly, another object is to provide an improved plug wrench which firmly grasps both posts, instead of applying a prying force therebetween, so as to prevent breaking off the posts when the plug is tightened hard.

Another object is to provide an improved plug wrench, which, in one design thereof, includes a groove for guiding the posts, while being moved between the wrench holes, so that, while the wrench is disconnected from the posts, it is kept in alignment therewith, so the posts and holes are readily mated at each turn of the wrench, instead of hunting wildly, at random, to align the same.

Other objects are to provide an improved plug wrench, which is simple in design, inexpensive to manufacture, rugged in construction, easy to use and efficient in operation.

These, and other objects, will be readily evident, upon a study of the following specification, and the accompanying drawing, wherein.

Figure 1:
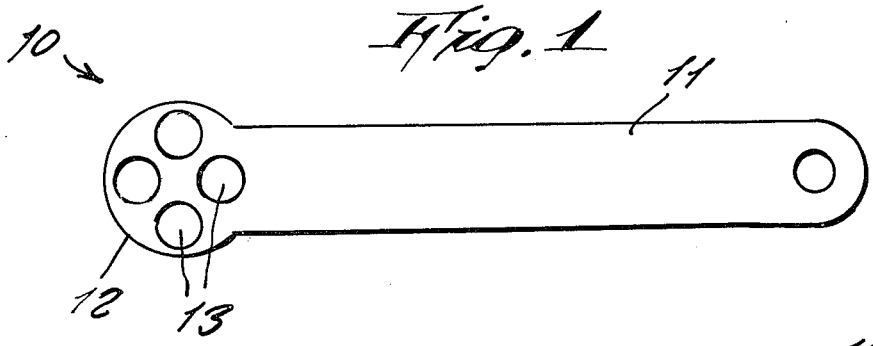
FIG. 1 is a top view of one design of the invention.
Figure 2:
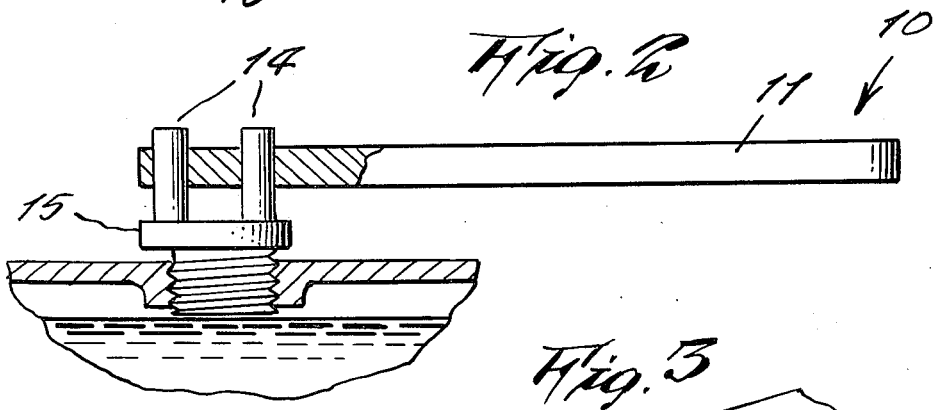
FIG. 2 is a side view thereof, partly in cross-section and shown in use.

Referring now to the drawing in greater detail, and more particularly, to FIGS. 1 and 2 thereof, at this time, the reference numeral 10 represents a plug wrench, according to the present invention, wherein there is a straight handle 11, having a working head 12 at one end, which includes a circle of four holes 13 therethrough. The holes are diametrically spaced apart on the head, so as to fit precisely the distance between prongs or posts 14, that are integrally formed on top of an oil plug 15 of a Briggs and Stratton engine, so that, in use of this wrench, the tool is simply placed over the plug, and the holes are fitted upon the posts, in order that the wrench is thus firmly secured to the plug, and can then be turned, so as to loosen or tighten the plug during a screwing operation.

Figure 3:
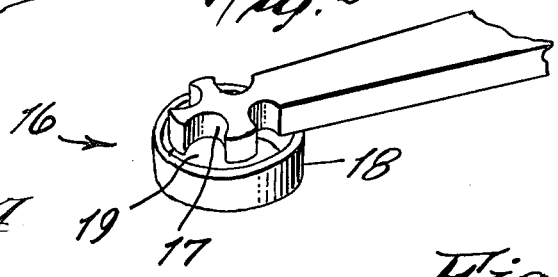
FIG. 3 is a perspective view of another design of the invention, wherein a guiding collar is integrally formed on one side of the wrench.
Figure 4:
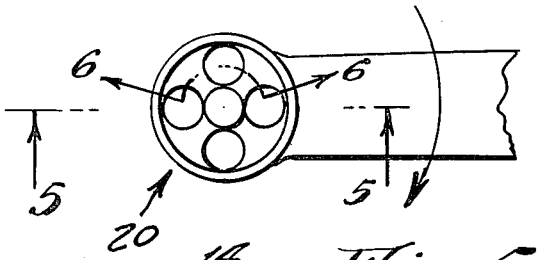
FIG. 4 is a fragmentary top view of still another design thereof, which includes the feature of FIG. 3.

In FIG. 3, another design of plug wrench 16 includes a working head 17, which, instead of having the circular holes 13, has notches 17, into which the posts fit, the notches being on a circumference of the head. A collar 18, rigidly formed on one side of the head, has a central opening 19, which is of a size so as to contain and enclose both posts therein. The collar serves as a guide, for retaining the posts in close proximity to the notches, while the posts are disengaged from the notches during the interval that the wrench is being repositioned between partial turns thereof, thus eliminating the need, at each turn, to hunt for the posts by a wrench completely disassociated therefrom.

In FIGS. 4 through 7, another improved plug wrench 20 is shown, that incorporates the guide feature of wrench 16 on each opposite side thereof, and wherein the guide feature on one side serves in loosening a plug, and, on its other side, serves to tighten a plug.

The wrench 20 includes a circular groove 21, on each opposite side thereof, which is located between a circular raised bead 22 and a central, circular protrusion 23, so that, while a post is disengaged from a hole, the post can travel in the groove, while being transferred from one hole to a next.

Figure 7:
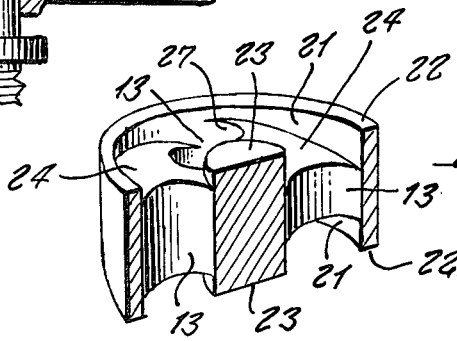
FIG. 7 is a fragmentary perspective view of the working head shown in FIG. 4.

In the design shown, the face 24, that forms a bottom surface of the groove, and which is located between adjacent holes, is angularly inclined, as is best shown clearly in FIG. 7, and which serves to guide the post downwardly into the hole, as the post approaches the hole during a turning of the wrench between grasps of the tool.

On one side of the head, the downward incline is clockwise, whereas, on the other side, it is counter-clockwise, so that one side is used for loosening a plug, while the other side is used for tightening thereof.

Figure 6:
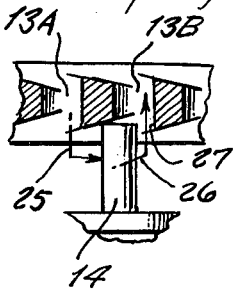
FIG. 6 is a straightened cross-sectional view, taken along curved line 6—6 of FIG. 5.
Figure 5:
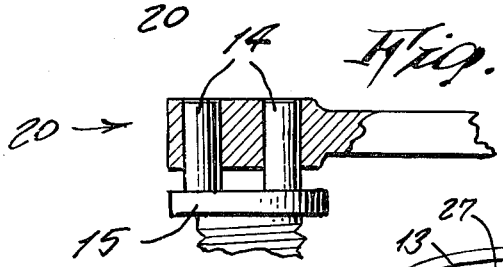
FIG. 5 is a cross-sectional view, on line 5—5 of FIG. 4, and shown in operative use.

As shown in FIG. 6, the arrow 25 shows the path taken by the post 14, when removed from hole 13A. The arrow 26 shows the path the post takes to enter the next hole 13B. It is to be noted, that the arrow 26 has an angular leg corresponding to the angular face 24, so as to show that the post can be axially moved, while traveling in the groove 21 between the holes. The travel is aborted when the side of the post abuts the raised side 27 of the hole 13B, so that the hole is thus easily found by the post.

While various changes may be made in the detail construction, it is understood that such changes will be within the spirit and scope of the present invention, as is defined by the appended claims.

What I now claim is:

1. A plug wrench comprising, in combination, an elongated handle having a working head at one end consisting of a circle of parallel holes through said head and guide means on each opposite side of said head, to prevent distant separation of said head from posts when loosening or tightening said plug, said guide means comprises a circular, inclined groove across the ends of said holes, wherein said groove, on one side of said head, is clockwise, and, on the other side thereof, is counter-clockwise.

* * * * *